United States Patent [19]

Knapp

[11] 4,015,529

[45] Apr. 5, 1977

[54] ILLUMINATIVE AND INCENDIARY EXPLOSIVE MUNITIONS

[75] Inventor: Charles A. Knapp, Wayne, N.J.

[73] Assignee: The United States of America as represented by the Secretary of the Army, Washington, D.C.

[22] Filed: Jan. 16, 1976

[21] Appl. No.: 649,624

Related U.S. Application Data

[60] Division of Ser. No. 583,720, June 4, 1975, Pat. No. 3,959,041, which is a continuation of Ser. No. 347,602, April 3, 1973, abandoned.

[52] U.S. Cl. ..... 102/66; 102/90

[51] Int. Cl.[2] ..... F42B 13/14

[58] Field of Search ..... 149/2, 21, 35, 87, 92, 149/114; 102/66, 90

[56] References Cited

UNITED STATES PATENTS

| | | | |
|---|---|---|---|
| 3,617,405 | 11/1971 | Stevenson | 149/114 X |
| 3,830,671 | 8/1974 | McArdle | 149/114 X |
| 3,933,543 | 1/1976 | Madden | 149/21 |

*Primary Examiner*—Leland A. Sebastian

*Attorney, Agent, or Firm*—Nathan Edelberg; A. Victor Erkkila

[57] ABSTRACT

This invention involves the incorporation of a relatively small quantity of zirconium or other pyrophoric material in the high explosive composition of a munition, which provides incendiary, terrain illumination, spotting, and enhanced antipersonnel properties to the munition with little or no diminution of its explosive and fragmentation power.

7 Claims, No Drawings

ILLUMINATIVE AND INCENDIARY EXPLOSIVE MUNITIONS

The invention described herein may be manufactured, used and licensed by or for the Government for governmental purposes without the payment to me of any royalty thereon.

This is a division of application Ser. No. 583,720, filed June 4, 1975, now U.S. Pat. No. 3,959,041, which is a continuation of original application Ser. No. 347,602, filed Apr. 3, 1973, now abandoned.

BACKGROUND OF THE INVENTION

At the present state of the art explosive munitions have destructive power but very little fire starting and luminous output capabilities. Therefore, different types of munitions must be employed for different purposes, e.g. fragmentation types for antipersonnel use, incendiary types for starting fires, etc. It would be highly desirable for a single munition to have all the above capabilities. This would provide the Armed Forces with improved capability over the present day standards and greatly simplify logistics.

SUMMARY OF THE INVENTION

The present invention provides incendiary, terrain illumination, spotting, enhanced antipersonnel, including psychological and physiological, capabilities to a munition by virtue of the incorporation of a relatively small quantity of pyrophoric material in the explosive composition of the munition.

Pyrophoric materials are capable of igniting spontaneously when exposed to air. Usually the term refers to finely divided materials, e.g. metals, etc. which ignite spontaneously in contact with air at ordinary temperatures. The term pyrophoric, as used in the present invention, refers to those materials, e.g. metals, which are too coarse to be pyrophoric at ordinary temperatures but which ignite spontaneously in air when heated to extremely high temperatures and/or when disintegrated to fine pyrophoric particles by the explosion of the high explosive, e.g. TNT (2, 4, 6-trinitrotolune), associated with such materials in the novel munition compositions of this invention.

The preferred pyrophoric material employed in the present invention is zirconium metal in view of the superior incendiary and illuminating properties it imparts to the novel compositions. Amounts of zirconium ranging from about 5 to about 30%, and preferably about 10 to about 20%, by weight of the zirconium-high explosive mixture can be employed with excellent results, although the invention is not limited thereto. Also, the particle size of the zirconium can be varied widely depending on the effects desired, e.g. duration of burning and distance of travel of such burning particles. Thus, granules and chunks of zirconium up to about ½ inch thick, strips or sheets about 2 or more inches long, etc., can be employed.

Similar effects can be attained with other metals such as Ti, Mg, Al, Mn, Fe, B, Be, Hf, Mo, Cu, Zn, Si, Pb, misch metal, rare earth metals.

Upon detonation of the explosive containing the pyrophoric material, e.g. zirconium, there is produced a bright flash which illuminates the surrounding terrain. The burning zirconium is spread over a wide area (that is from 50-1000 feet in radius) from the burst point of the exploding munition where the Zr particles continue to burn and ignite combustible materials that they contact. Gasoline, kerosene, diesel fuel, hay, straw and brown grass have been successfully ignited in this manner.

DESCRIPTION OF THE PREFERRED EMBODIMENT

The invention is illustrated by the following examples wherein the parts are by weight.

EXAMPLE:

10 parts of zirconium metal granules whose average particle size was 1/10 inch were mixed with 90 parts of molten TNT and the mixture was solidified by cooling.

In similar manner other mixtures of various explosives and zirconium in various proportions ranging up to about 30% were prepared.

The following table shows the distance of travel of the burning zirconium particles from the point of burst and the duration of burning of such particles when the explosive mixtures prepared above were loaded into various munition types and exploded.

Zirconium Burning Duration As A Function Of Particle Size

| Screen* Fraction | Nominal Size | Burning Duration sec (approx) | Distance Traveled ft. max (approx) | Munition Tested | Explosive |
|---|---|---|---|---|---|
| 140/200 | .004 | .2 | | 40 mm | TNT |
| 20/30 | .03 | .6 | | 40mm | TNT |
| 12/16 | .06 | 1.2 | | 40mm | TNT |
| 8/12 | .08 | 1.5 | | 40mm | TNT |
| 6/8 | .1 | 1.7 | 200–300 | BLU 26 | Comp B |
| | | | | 40mm | TNT |
| 1/4"/6 | .2 | 3.4 | 300–400 | BLU 26 | Comp B |
| | | | | BLU 61 | Cyclotol 70/30 |
| 3/8"/5 | .3 | < 5 | 400 | BLU 61 | Cyclotol 70/30 |
| 3/4"/6 | .5 | < 10 | 1000 | BLU 49 | Cyclotol 70/30 |
| | | | | MK 82 500 lb. bomb | Tritonal 80/20 |

*U.S. Standard Sieve Series, passing/retained on

Pyrotechnic and incendiary compositions containing particles of zirconium and other metals mixed with an oxidizing agent, such as potassium perchlorate, barium nitrate, etc., are known. It was thought that if such metals were mixed with a high explosive like TNT, they would be so disintegrated by the explosive forces as to be consumed in a "flash" and provide little or no incendiary or extended illuminating capability. It was therefore unexpected to find that the munition composition of the present invention containing a high explosive and metallic zirconium pieces of various size, as illustrated above, generate burning particles of the metal, which possess long duration of burning and distance of travel, whereby such compositions provide a hitherto unattained combination of high explosive power with excellent incendiary and illumination capability.

In addition to TNT, other high explosives mixed with zirconium can be employed with similar results, such as for example. Composition A-3 a mixture of 91 parts cyclotrimethylenetrinitramine and 9 parts wax, cyclotols mixtures of cyclotrimethylenetrinitramine and 2, 4, 6-trinitrotoluene in the weight ratios of 75/25, 70/30, 65/35, 60/40), Composition B (a mixture of 60 parts cyclotrimethylenetrinitramine and 40 parts 2,4,6-trinitrotoluene and 1% added wax) Tritonal (80/20) (a mixture of 80 parts 2,4,6-trinitrotoluene and 20 parts aluminum), RDX/$PbN_6$ cyclotrimethylenetrinitramine and lead azide. Such high explosives are fully described in Army Material Command Pamphlet AMCP 706-177 dated March, 1967, pages 43, 76–85, 46, 386, 69/182. Some of the munitions in which the above compositions performed successfully are: Cartridge, He, 40mm, M384; mk 82, 500 pound General Purpose Bomb; BLU 61, Fragmentation Bomb; /Experimental Fragmentation Mine "FM"; BLU 26, Fragmentation Bomb; Mine, AP, Anti-intrusion XM 45 EI.

Incorporation of the zirconium or other pyrophoric particles into the high explosive can be accomplished in a number of ways. In the case of powdered explosives the pyrophoric can be preblended according to standard procedures with the high explosive (HE) such as Comp A3. The explosive/pyrophoric mixture is press loaded into the munition according to standard press load procedures. In the case of pour-melt explosives such as Composition B, the pyrophoric material can be placed in the projectile cavity prior to pouring the explosive into the same or it can be added after the HE pour but while the HE is still in the liquid phase.

The pyrophoric material in particulate form can also be positioned on, e.g. cemented to, the liner of a shaped charge on the explosive side, so that the jet of the liner is followed by the pyrophoric material and enhances the incendiary capability of the shaped charge.

Certain pyrophoric materials, namely zirconium, titanium misch metal and uranium, can be utilized successfully in association with a high explosive according to present invention in the form of large strips or sheets or as a liner adhered to the inner wall of the projectile.

What is claimed is:

1. In a shaped charge, a composition having illuminating and incendiary properties comprising a high explosive and a pyrophoric metal selected from the group consisting of zirconium, titanium and misch metal, wherein said pyrophoric metal possesses a particle size of at least about 1/10 inch and is attached to the shaped charge liner on the side adjacent to said high explosive.

2. The shaped charge of claim 1, wherein the metal is zirconium.

3. The shaped charge of claim 1, wherein the metal is titanium.

4. The charge of claim 1, wherein the metal possesses a particle size between about 1/10 inch and about ¾ inch.

5. The shaped charge of claim 1, wherein the high explosive consists of 2,4,6-trinitrotoluene and the metal is zirconium.

6. The shaped charge of claim 1, wherein the metal amounts to from about 5% to about 30% by weight of the total explosive/metal content.

7. The shaped charge of claim 1, wherein the high explosive is selected from the group consisting of at least one of the following:

1. mixtures of cyclotrimethylenetrinitramine and 2,4,6-trinitrotoluene in the weight ratios resp. of 75/25, 70/30, 65/35 and 60/40;
2. a mixture of 91 parts cyclotrimethylenetrinitramine and 9 parts wax;
3. a mixture of 60 parts cyclotrimethylenetrinitramine and 40 parts 2,4, 6-trinitrotoluene and 1% added wax;
4. a mixture of 80 parts 2,4,6-trinitrotoluene and 20 parts aluminum;
5. lead azide;
6. cyclotrimethylenetrinitramine; and
7. 2,4,6-trinitrotoluene.

* * * * *